United States Patent [19]

Czerwinski

[11] 4,201,989

[45] May 6, 1980

[54] WIDEBAND ANTENNA WITH FREQUENCY DEPENDENT FERRITE CORE INDUCTOR

[75] Inventor: Watson P. Czerwinski, Forked River, N.J.

[73] Assignee: The United States of America as represented by the Secretary of the Army, Washington, D.C.

[21] Appl. No.: 28,934

[22] Filed: Apr. 11, 1979

[51] Int. Cl.[2] ..... H01Q 1/32; H01Q 9/38

[52] U.S. Cl. ..... 343/715; 343/752; 343/787; 343/828

[58] Field of Search ..... 343/715, 745, 749, 750, 343/752, 787, 828, 829, 830

[56] References Cited

U.S. PATENT DOCUMENTS 3,967,276 6/1976 Goubau ..... 343/828

4,047,178 9/1977 Czerwinski ..... 343/750

*Primary Examiner*—Eli Lieberman

*Attorney, Agent, or Firm*—Nathan Edelberg; Jeremiah G. Murray; Edward Goldberg

[57] ABSTRACT

Disclosed is a low profile wideband VHF antenna wherein impedance matching over the required operating band is provided without the use of multiple circuit components, for tuning, switched into and out of the antenna by an assembly of switch contacts. The antenna is comprised of an end and preferably a bottom fed vertical radiating rod or monopole element whose upper end is terminated in a substantially flat circular top capacitance disc via a frequency sensitive inductance constructed of a ferrite core inductor whose $\mu$ characteristic varies approximately inversely with respect to frequency.

14 Claims, 5 Drawing Figures

WIDEBAND ANTENNA WITH FREQUENCY DEPENDENT FERRITE CORE INDUCTOR

The invention described herein may be manufactured and used by or for the Government for governmental purposes without the payment of any royalties thereon or therefor.

BACKGROUND OF THE INVENTION

The present invention relates generally to antennas of electromagnetic radiation and more particularly to radio frequency antennas whose physical size (length) is a small fraction of the wave length at the frequency of operation.

Electrically small antennas are of great importance for military use because they provide adequate electrical performance without the inconvenience often associated with full sized antennas. In order to utilize such antennas over a relatively wide bandwidth, however, one must normally tune the antenna with suitable impedance matching devices which include switching of preset components into the system in discrete steps, each step normally being less than 10% bandwidth in a typically 3:1 operational frequency range, for example, 30–80 MHz.

It is an object of the present invention, therefore, to provide an electrically short antenna system which obviates the need for mechanically switched components to provide tuning of the antenna.

It is another object of the present invention to provide an improved VHF antenna particularly adapted for military applications.

And it is yet another object of the present invention to provide an improved VHF antenna having wide band operation which is simple in construction but is adapted to operate in relatively harsh environments.

SUMMARY

These and other objects are realized by the subject invention which comprises an end fed monopole antenna including a generally vertical radiating element whose electrical length is less than one eighth of the operating wave length i.e. $\lambda/8$. The radiating element in its preferred embodiment comprises a substantially hollow length of metal tubing mounted on a counterpoise and including source impedance transformer means located inside of the tubing. The other end of the radiating element is electrically coupled to a capacitance disc which is fastened to a dielectric support member mounted on the top of the radiating element. Coupling between the radiating element and the capacitance disc is provided by means of a frequency dependent ferrite core inductor having a tapered $\mu$ response which exhibits a conjugate reactance response relative to that of the antenna structure. In one embodiment the inductor is housed within a protective metallic cap which is electrically connected to the capacitance disc. The cover cap is additionally adapted to accommodate a whip antenna element which when mounted thereon is adapted to extend the operating range of the antenna without seriously affecting antenna performance insofar as its tuning characteristics are concerned.

DESCRIPTION OF THE PREFERRED EMBODIMENTS

Figure 1:
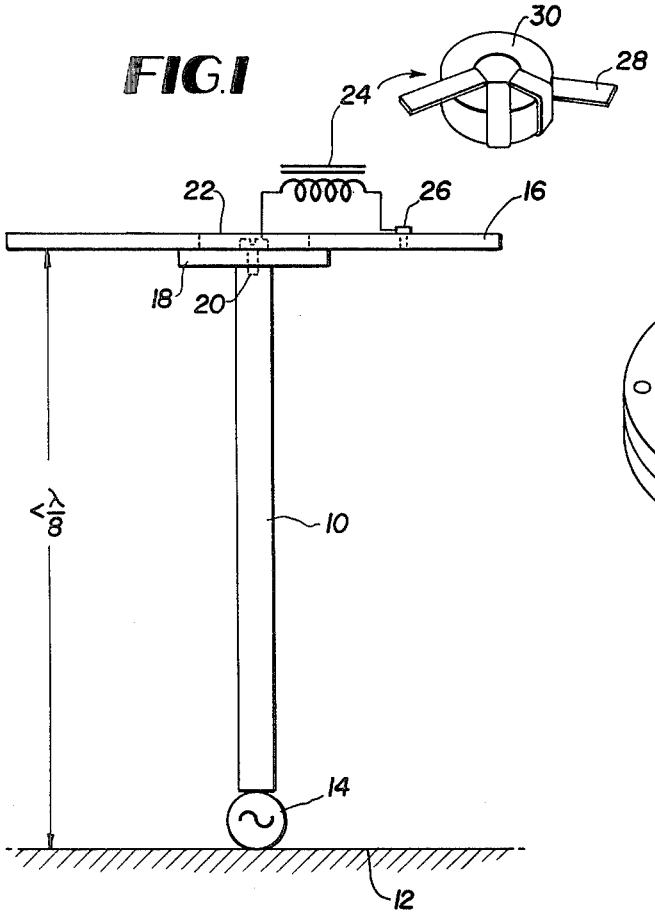
FIG. 1 is a diagram schematically illustrative of the basic embodiment of the subject invention.
Figure 3:
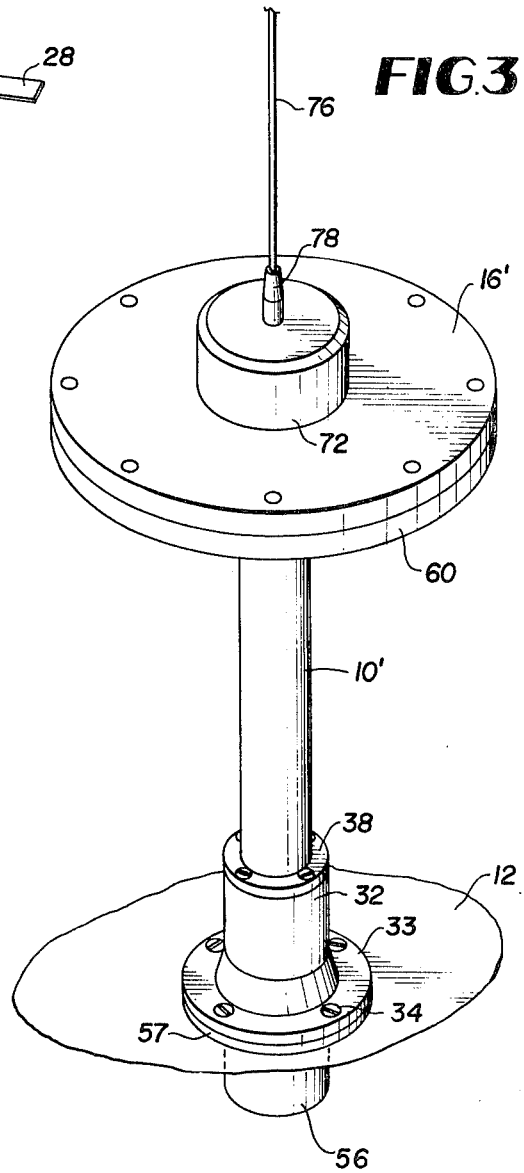
FIG. 3 is a perspective view of the preferred embodiment of the subject invention.
Figure 2:
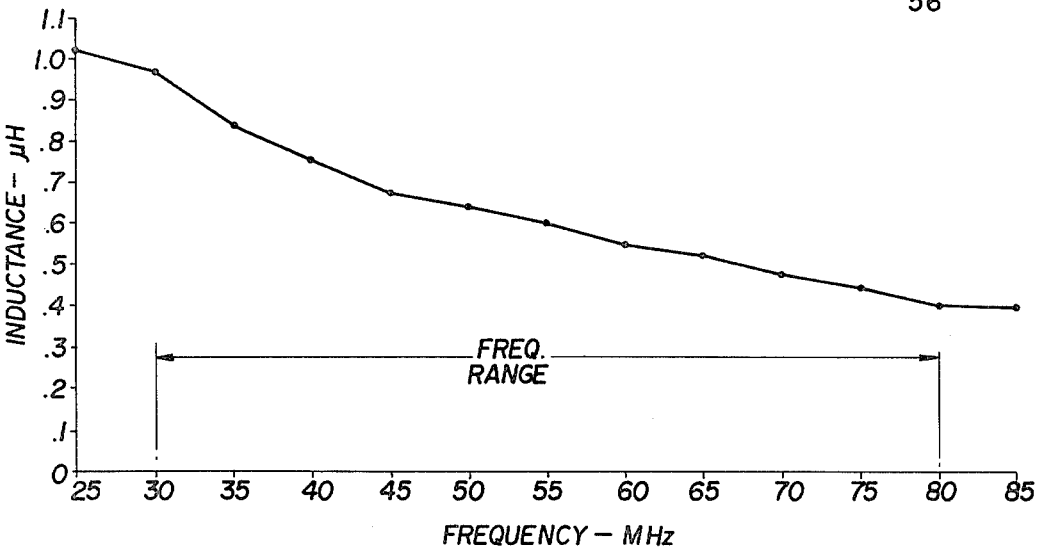
FIG. 2 is a graph helpful in understanding the operation of the subject invention.

Referring now to the drawings wherein like numerals refer to like components throughout, reference is first made to FIG. 1 which is intended to broadly disclose the primary elements of the subject invention which is directed to a wideband low profile antenna operable, for example, in the range extending from 30 to 80 MHz of the VHF band. Reference numeral 10 denotes a vertical monopole radiating element preferably consisting of a length ($<\lambda/8$) of metal tubing, typically 18" in length. The radiating element 10, moreover, is mounted on a metal counterpoise 12, which may be, for example, a vehicle or a ground radial system. One end, which in the instant embodiment comprises the lower end, is coupled to an excitation source 14 through an impedance transformer, not presently shown, but which will be considered subsequently when FIG. 3 is discussed. The opposite or upper end of the radiating element 10 is capacitively top loaded by means of a generally circular metal disc 16 which for an operating range of 30 to 80 MHz, typically has an outside diameter of 17". The circular top capacitance metal disc 16 is mounted on an insulation member 18 consisting of, for example, a dielectric disc also circular in configuration which is fastened to the top of the radiating element 10 by means of a hardware screw 20. The capacitance disc 16 includes an aperture 22 consisting of, for example, a circular opening through to the dielectric disc 18. Through the opening 22 a frequency sensitive inductive reactance device 24 is connected between the top of the radiating element 10 and the capacitance disc 16, for example by means of the screws 20 and 26. The device 24 comprises a frequency sensitive inductor formed by means of 2–3 turns of electrical conductive tape or strip material 28 wound on a ferrite core 30 whose $\mu$ characteristic decreases as frequency increases over the 30–80 MHz range providing a frequency vs. inductance characteristic for the inductor 24 as shown in FIG. 2. A typical example of the core 30 is a "Q-1" type F-568-1 ferrite torroidal core manufactured by General Ceramics, which is a division of Indiana General Corporation.

As evidenced from the characteristic curve shown in FIG. 2, the inductance is approximately inversely proportional to frequency. It is this device which eliminates the need for switching of preset components in discrete steps for impedance matching inasmuch as the ferrite material provides a high inductive reactance where needed at the bottom of the 30–80 MHz band and a correspondingly needed low inductive reactance at the top end of the band. The inductor 24 thus configured exhibits a conjugate reactance response relative to that of the antenna structure, thus obviating the problem of impedance matching over the required band of operation.

Figures 4, 5:
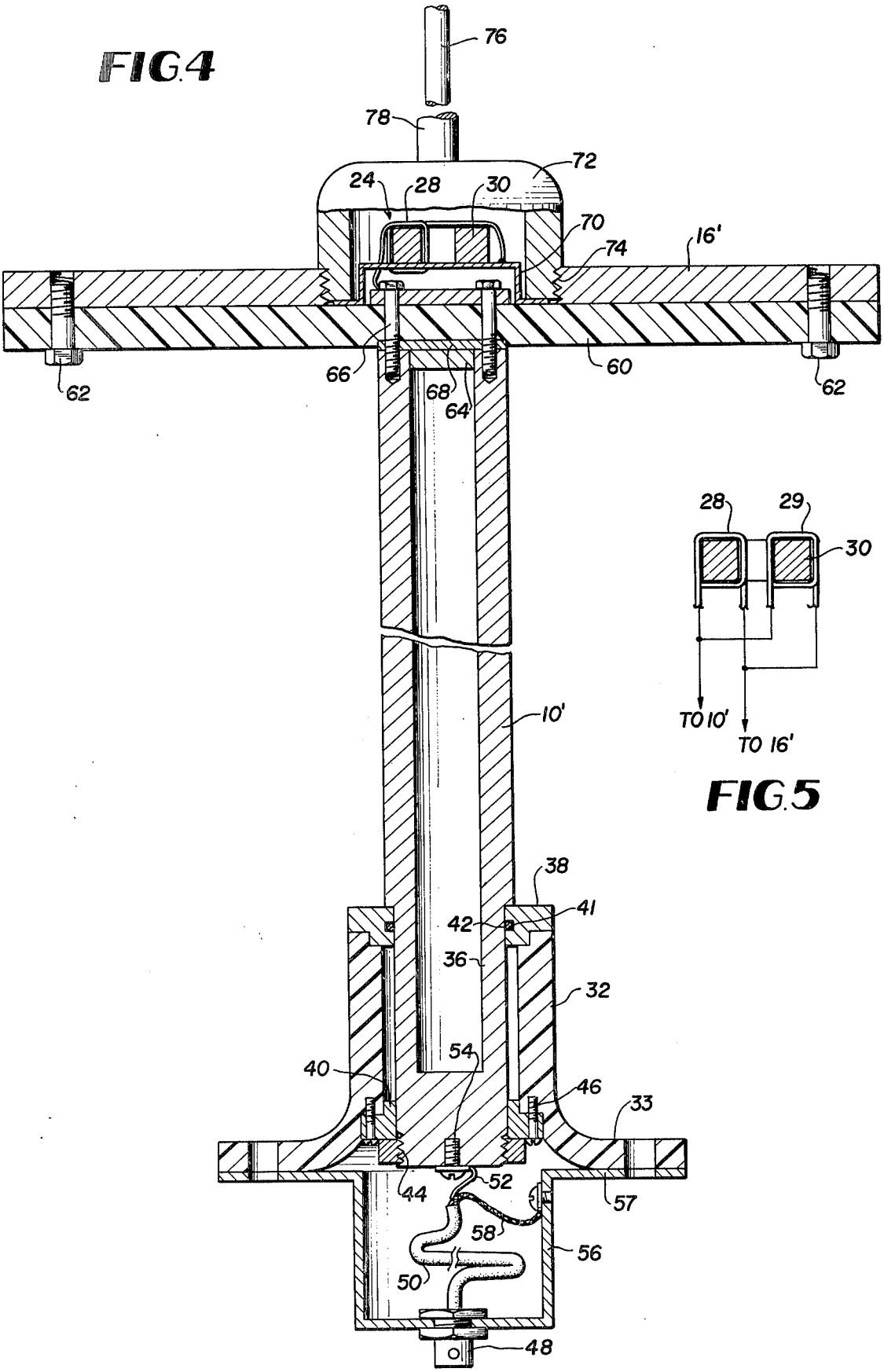
FIG. 4 is a sectional view of the embodiment shown in FIG. 2 taken along the central axis thereof.
FIG. 5 is a cross sectional view illustrative of another ferrite core inductor configuration utilized in connection with the subject invention.

Referring now to FIGS. 3 and 4, there is disclosed the preferred embodiment of the subject invention which is adapted to provide a low profile ballistic resistant armor antenna having particular utility in the military. In this embodiment a substantially hollow tubular antenna element 10', similar to element 10 shown in FIG. 1, is mounted on a base insulator 32 having a lower flange portion 33 which is attached to the counterpoise 12 by means of suitable hardware 34. As shown in FIG. 4, the tubular radiating element 10' has a reduced outside diameter portion 36 at its lower end where it is adapted to fit inside the base 32 and be held in place by means of upper end lower collar members 38 and 40. The upper collar additionally includes a recess 41 for an O-ring 42. The lower collar 40 is threaded and is adapted to engage the screw threads 44 of the tubular radiating element 10'. The lower collar 40 is fastened to the insulator base 32 by means of the hardware 46.

The subject embodiment further is adapted to be coupled to an excitation source, not shown, by means of an RF connector 48 and a length of coaxial cable 50. The length of the coaxial cable 50 for the frequency range of 30–80 MHz is typically 25" acts as an impedance transformer for RF energy source and is coupled to the closed bottom of the radiating element 10' by means of the inner conductor 52 of the coaxial cable. Attachment is made by means of the screw member 54. The length of coaxial cable 50, moreover, is adapted to be contained in a metallic can or casing 56 which is bonded at the flange 57 to the base insulator 32. The outer conductor or braid 58 of the coaxial cable 50 is attached to the metallic container 56 which when assembled on the counterpoise 12 via the mounting flange 57, will be at ground potential. Accordingly, the only element protruding from the container 56 is the RF connector 48.

Turning attention now to the top portion of the embodiment shown in FIGS. 3 and 4, reference numeral 60 designates a generally circular disc insulator element 62 comprised of plastic armor plate material. The shape of the plastic armored insulator disc 60 matches the shape of the top capacitance disc 16' and the two members are held together by means of a plurality of screw threaded bolts 62. The radiating element 10' includes an end plug 64 at its upper extremity and has a wall thickness thereat sufficient to accommodate a pair of mounting bolts 66 which is adapted to retain the insulator member 60. A gasket 68 is further placed intermediate the radiating element 10' and the insulator disc 60. The ferrite inductor 24 in the instant embodiment is positioned on a bracket member 70 which is held in place by means of a relatively thick hollow metal cap 72 which is adapted to primarily protect the inductor 24. The metal cap 72 is threaded to engage a correspondingly threaded circular aperture 74 in the top capacitance disc 16', thus providing a ruggedized antenna structure which is adapted for use on an armored vehicle such as a tank.

It should be pointed out that when desirable a grounded base version of the antenna configuration shown in FIG. 4 may be resorted to which eliminates the base insulator member 32. In a grounded base version, not shown, the radiating element 10' would include an opening in the bottom whereupon the coaxial cable 50 would be located interiorally of the radiating element 10 with the braid 58 electrically connected to the top of the radiating element at the plug 64 while the inner conductor 52 would pass through a suitably drilled hole in plug 64 and being attached to one terminal of the ferrite core inductor 24. In all other respects the antenna configuration remains the same.

It should also be noted that the protective cap or cover 72 for the ferrite inductor 24 is in electrical contact with the top capacitance disc 16' due to the screw thread engagement therewith. The present invention, accordingly when desirable, is intended to additionally include a vertical whip antenna element 76, which acts to increase the antenna displacement current, thus leading to increased radiation efficiency and transmission range. For operating frequencies in the range of 30–80 MHz, the whip antenna element typically comprises a 4.5' relatively small diameter whip having a base 78 which is adapted to be screwed into the protective cover 72.

As noted with respect to FIG. 2, the inductance of the inductor 24 is adapted to decrease with respect to frequency, which is the opposite of the response normally obtained without the type of ferrite core utilized. Conventionally, the reactance increases with frequency, however, in the instant invention the increase in reactance can be offset by the decrease in inductance, and thus the operational bandwidth of the antenna is extended without additional circuitry being switched into the network.

It should be pointed out that when desirable, the steepness of the inductance vs. frequency characteristic shown in FIG. 2 can be increased by including a second 2–3 turn winding 29 on the ferrite core 30 as shown in FIG. 5 and connecting the two windings 28 and 29 together in parallel.

Thus what has been shown and described is a VHF antenna consisting of a monopole radiator with a top capacitance disc insulated from the monopole and coupled thereto by means of a frequency dependent ferrite core inductor whose ferrite material exhibits a tapered or sloping $\mu$ response providing thereby a high inductive reactance at the bottom end of the VHF band and a correspondingly low inductive reactance at the top of the band, thereby eliminating the need of tuning devices or switch contacts conventionally required for antenna tuning.

In addition to being adapted to be mounted on the surface of a tactical vehicle such as a tank, the antenna comprising the subject invention can be used with multicouplers for simultaneous operation with several different radio sets. It can also be used for frequency hopping operation techniques. Additionally, immunity to EMP effects is provided due to the elimination of impedance matching components such as capacitors.

While there has been shown and described what is at present considered to be the preferred embodiment of the present invention, modifications thereto will readily occur to those skilled in the art. It is not desired, therefore, that the invention be limited to the specific arrangements shown and described, but it is intended to cover all such modifications as fall within the spirit and scope of the invention as defined in the appended claims.

What is claimed is:

1. A low profile wideband antenna system coupled to radio apparatus operable over a predetermined frequency range and adapted for VHF operation, comprising in combination:

a counterpoise;

an end fed monopole antenna element mounted on said counterpoise;

a top capacitance loading element located at the opposite end of said antenna element from said counterpoise; and a frequency dependent series inductor coupled between said antenna element and said top capacitance loading element, said frequency dependent series inductor including a winding wound on a core of ferrite material which material exhibits a $\mu$ characteristic which decreases with respect to frequency over a predetermined portion of said frequency range.

2. The antenna system as defined by claim 1 wherein said frequency dependent series inductor comprises a winding of electrical conductor wound on a torroidal core of said ferrite material.

3. The antenna system as defined by claim 2 wherein said winding is comprised of at least two turns of strip conductor wound on said core.

4. The antenna system as defined by claim 2 wherein said monopole antenna element consists of an electrically short conductor element having an electrical length less than one eighth wavelength for said operating frequency range.

5. The system as defined by claim 4 wherein said top capacitance loading element comprises a generally thin, flat metallic member mounted on the top of said antenna element.

6. The system as defined by claim 4 wherein said electrically short conductor element comprises a generally vertically oriented cylindrical conductor of predetermined cross section and wherein said top capacitance loading element comprises a generally thin, flat circular member having a diameter substantially greater than the cross sectional diameter of said conductor element and mounted on the top thereof.

7. The antenna system as defined by claim 2 wherein said frequency dependent series inductor is located above said top capacitance loading element and additionally including cover means secured to said loading element and enclosing said series inductor.

8. The system as defined by claim 7 wherein said loading element comprises a generally flat metal member and additionally including an insulator member secured to the top of said antenna element intermediate said flat metal member.

9. The system as defined by claim 8 wherein said insulator element and said top loading element are comprised of like shaped members generally circular in configuration.

10. The antenna system as defined by claim 2 wherein said frequency dependent series inductor is located on the top side of said capacitance loading member, and additionally including a metal cover enclosing said series inductor over said loading element and being in electrical contact with said loading element.

11. The system as defined by claim 10 and additionally including a whip antenna mounted on and being in electrical contact with said metal cover.

12. The antenna system as defined by claim 2 and additionally including a base insulator member secured to said counterpoise and providing a mount for said antenna element, said antenna element including a feed point located at the bottom of said antenna element and additionally including circuit means coupling said radio apparatus to said feed point.

13. The system as defined by claim 12 wherein said last recited circuit means includes a predetermined length of electrical conductor operating as an impedance transformer coupled between said feed point and said radio apparatus.

14. The antenna system as defined by claim 2 wherein said monopole radiating element comprises a length of hollow conductor and additionally including impedance transformer means in the form of a predetermined length of electrical conductor located interiorally of said hollow conductor and being connected between said feed point and said radio apparatus.

* * * * *